United States Patent [19]

Shipp

[11] 4,397,117

[45] Aug. 9, 1983

[54] DOOR WITH REMOVABLE SHEET

[75] Inventor: Earl H. Shipp, Bedford, Mass.

[73] Assignee: Eckel Industries, Inc., Cambridge, Mass.

[21] Appl. No.: 322,772

[22] Filed: Nov. 19, 1981

[51] Int. Cl.[3] ..... E06B 3/00

[52] U.S. Cl. ..... 49/501

[58] Field of Search ..... 49/501, 502, 171, 170, 49/169; 52/455, 456, 785

[56] References Cited

U.S. PATENT DOCUMENTS

| | | | |
|---|---|---|---|
| 2,913,780 | 11/1959 | Weisselberg | 49/171 X |
| 3,325,943 | 6/1967 | Kochis | 49/502 X |
| 3,979,872 | 9/1976 | Gilchrist et al. | 49/501 X |
| 4,327,535 | 5/1982 | Governale | 49/501 X |

*Primary Examiner*—Philip C. Kannan

*Attorney, Agent, or Firm*—Schiller & Pandiscio

[57] ABSTRACT

A windowed door is provided with an internal compartment accommodating a window pane having an area at least twice that of the window aperture. The compartment and aperture are eccentrically disposed with respect to one another such that a portion of the pane not previously exposed through the aperture is exposed when the pane is reversed in the compartment.

10 Claims, 4 Drawing Figures

DOOR WITH REMOVABLE SHEET

BACKGROUND OF THE INVENTION

This invention relates to doors having a window portion and more particularly to such doors in which the window portion is easily replacable.

Windowed doors are well known and are commonly employed as a safety measure for swinging doors and the like, and particularly for those used in heavily trafficked areas. While the windows in such doors may be installed by conventional means, such as glazier's points and glazing compound, the heavy use of frequently used doors subjects the windows to potential damage, and ease of replacement of the window becomes an important concern. Such concerns are answered in part by doors accommodating framed window units, the entire framed unit being secured to the door, as by screws and being removable as a whole. Alternatively, transparent plastic sheeting which may itself be secured to the door by screws, has been used. An example of the latter type of door is disclosed in U.S. Pat. No. 3,325,943.

Aside from requiring the use of tools for the replacement of a window, such designs also require a replacement window. This may be disadvantageous in applications in which the door is used as an environmental barrier, such as the door to a cold room, clean room, or the like. While a user might stock spare windows, unless such spares are readily available, if the window in such a door becomes damaged either the visibility through the window or the environmental barrier provided by it must be sacrificed until a replacement window can be secured.

Accordingly, it is an object of the present invention to provide a windowed door in which the window pane may be readily removed and replaced with a minimum use of tools, and in which a damaged window pane may be manipulated so as to provide a temporary replacement window.

BRIEF DESCRIPTION OF THE INVENTION

These and other objects are met by the present invention of a door with a compartment therein for sliding a window pane into a window aperture. The compartment is so arranged within the door panel and the window pane is so dimensioned that only a portion of the pane is visible in the window aperture while a symmetrically disposed similar portion of the pane is concealed within the door. When the visible portion of the window pane becomes scratched or unclear the pane may be withdrawn and reinserted so that the previously concealed portion will be visible in the aperture and present an unobstructed view. Access to the compartment may be had either through the top or a side edge of the door. In the latter case, preferably the hinged edge of the door is used.

It will be appreciated that, since the pane may be secured in the door tightly by friction, no tools are required to remove or replace the pane. It will also be understood that the concealed portion of the pane serves, in effect, as a stored replacement window. Thus, a damaged window can be readily replaced, without tools, by simply reversing the pane.

Other objects of the invention will in part be obvious and will in part appear hereinafter. The invention accordingly comprises the apparatus possessing the features, properties, and relation of components which are exemplified in the following detailed disclosure, and the scope of the application of which will be indicated in the claims.

BRIEF DISCRIPTION OF THE DRAWINGS

For a fuller understanding of the nature and objects of the present invention, reference should be had to the following detailed description taken in connection with the accompanying drawings wherein.

In all figures, like numbers refer to like parts.

DETAILED DESCRIPTION OF THE DRAWINGS

Figure 1:
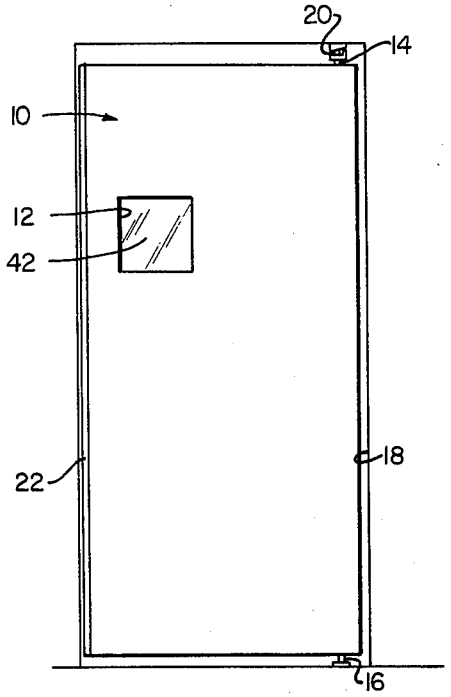
FIG. 1 is a front elevational view of a door incorporating the principles of the present invention.

Referring to FIG. 1, there may be seen a door 10 of substantially rectangular shape. Door 10 may be either a solid or hollow core door configured and fabricated, except as hereinafter described, in any manner and by any of the means well known in the art.

Door 10 is provided with a rectangular window aperture 12. As will be described in detail hereinafter, depending upon the particular embodiment of the invention, the width or height of window aperture 12 must be less than half the corresponding dimension of door 10. Also depending upon the particular embodiment, window aperture 12 must be displaced from either a vertical or horizontal edge of door 10 by at least a distance equal to the corresponding dimension of the aperture. Preferably, aperture 12 is situated at about eye level and nearer the front edge of the door (i.e., the vertical edge of the door remote from the hinges).

Door 10 is intended to be hung, as by pivot posts 14 and 16 attached respectively to the top and bottom of the door, from the top and bottom of doorway 18. In a preferred embodiment, post 14 incorporates a cam mechanism 20 of the type well known in the art, so disposed that door 10 will normally seek its closed position by gravity. It will be understood however that other forms of hinge can be used, and that the door need not be automatically closing or might be closed, for instance, by spring action. As the preferred embodiment is a swinging door, preferably its front edge is provided with a flexible nosepiece 22 designed to prevent any air gap between the edge of the door and the doorway.

Figure 2:
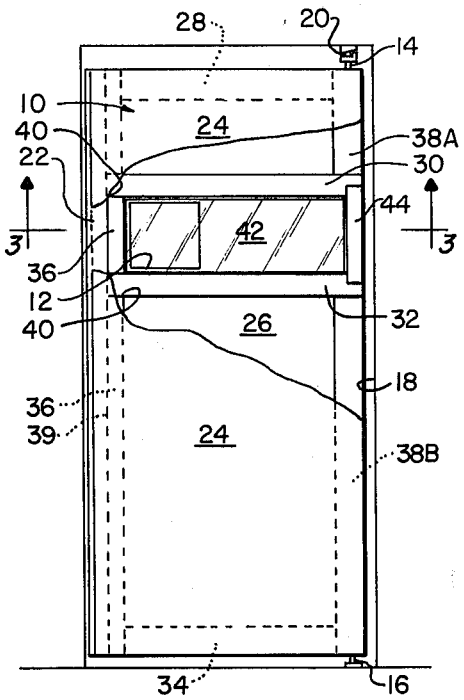
FIG. 2 is a view similar to FIG. 1 with a portion of the door panel removed to show the internal structure of a preferred embodiment of the present invention.

Turning to FIG. 2, there may be seen the internal arrangement of door 10. For purposes of illustration, door 10 is shown as a hollow-core door (although it will be recognized that the present invention might be equally applied to a solid-core door, as indeed is the case illustrated in FIG. 4). Door 10 comprises front and rear facings, in the form of panels 24 and 26 respectively, held apart, supported by, and in turn supporting, an orthogonal frame comprising rails 28, 30, 32, and 34 and stiles 36 and 38. Rails 28 and 34 are the normal top and bottom frame members of door 10. Rails 30 and 32 are cross-pieces situated respectively above and below the position of window aperture 12. Stile 36 frames the front edge of door 10. As an aid in locating and securing nosepiece 22, stile 36 may be provided with a pair of notches 39 (best seen in FIG. 3) which, together with panels 24 and 26 form a pair of grooves to receive the nose piece. The rear (i.e., hinged) edge of the door is framed by stile 38. Stile 38 is divided in two, forming partial stiles 38A and 38B running respectively between rails 28 and 30 and between rails 32 and 34. Stiles 36 and 38A support rail 30, while stiles 36 and 38B support rail 32. As an aid in locating and supporting rails 30 and 32, stile 36 may be provided with rabbets 40. Rails 30 and 32, together with stile 36 and front and rear panels 24 and 26, form a pocket at one end of which is window aperture 12.

Window pane 42 is a rectangular sheet of transparent material such as acrylic, polycarbonate, polystyrene, glass, or the like. Pane 42 has a thickness slightly less than the separation between front panel 24 and rear panel 26. In its other dimensions, pane 42 has a height slightly less than the separation between rails 30 and 32, and a width somewhat less than the width of door 10. Plug 44, of similar thickness to pane 42, and dimensioned to close off the aperture formed by rails 30 and 32 and front and rear panels 24 and 26 is also provided. Plug 44 is further dimensioned to be substantially equal to the difference between the width of door 10 and the sum of the widths of stile 36 and pane 42. Plug 44 may be held in place either by friction, or by screws (not shown) passing through the plug and into rails 30 and 32 or stiles 38A and 38B. While plug 44 may be provided with easily operated latching means (e.g., coin-operated screws or quarter-turn fasteners), tamper-proof latching means may also be used to prevent unauthorized access to pane 42.

In use, pane 42 is inserted into the compartment formed by rails 30 and 32, stile 36, and panels 24 and 26. When fully inserted, pane 42 contacts stile 36. Plug 44 may then be inserted into the open end of the compartment, forming a flush edge with the hinged edge of door 10 formed by stiles 38A and 38B. Plug 44 serves to retain pane 42 and to conceal its method of insertion.

Figure 3:
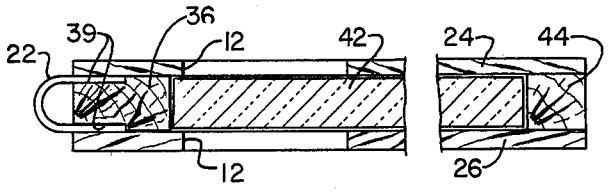
FIG. 3 is a partial section taken along the line 3—3 of FIG. 2.

It should be noted that in the embodiment illustrated in FIGS. 2 and 3 aperture 12 has a width less than about half the separation between stiles 36 and 38A or 38B, and aperture 12 is further disposed on panels 24 and 26 to be adjacent stile 36 and between rails 30 and 32. The eccentric location of window aperture 12 together with its width makes use of at most only half of pane 42, the remaining half being concealed within door 10. In the event that the portion of pane 42 exposed through aperture 12 becomes damaged, plug 44 may be removed and pane 42 may be slid from the door. The pane may then be reversed end-for-end, reinserted, and plug 44 repositioned to retain and conceal the pane. Thus, a temporary replacement window is provided by the previously unused portion of pane 42 and neither the environmental integrity nor the safety feature of the window in door 10 need long be sacrificed while awaiting procurement of a replacement pane 42.

It will be appreciated that the embodiment just described requires access to the hinged edge of door 10 for the reversal or replacement of pane 42. Consequently, this style construction is best utilized with swinging doors with top- and bottom-edge pivots, as shown, rather than rear-edge hinges or pivot bars. It will further be realized that this design preferably makes use of a plug, such as plug 44, not only to secure, but also to conceal, removable pane 42, since the hinged edge of the door is easily visible when the door is open.

Figure 4:
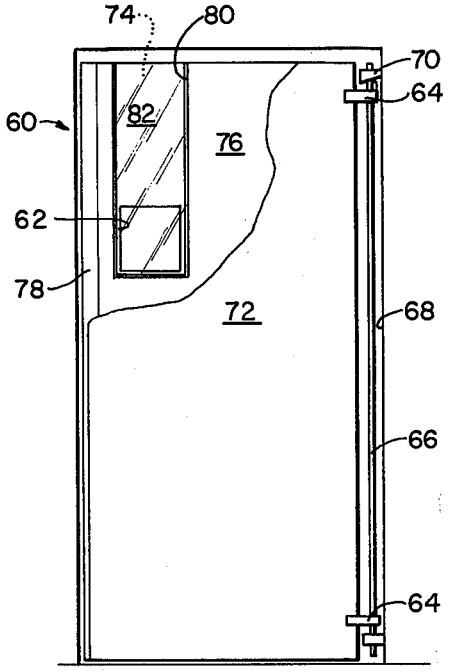
FIG. 4 is a view similar to FIG. 2 of an alternative embodiment of the present invention.

An alternative embodiment which may be used with either top and bottom pivots or rear-edge hinged doors, and which does not require a concealing and securing plug, is shown in FIG. 4. As may be seen, door 60, shown as a solid-core door for exemplary purposes, is provided with a rectangular window aperture 62. Door 60 is supported by brackets 64 and hinge post 66 attached to doorway 68 by brackets 70, one of which may incorporate a cam mechanism so as to automatically close door 60 by gravity.

Door 60 comprises front and rear facing panels, 72 and 74 respectively, held apart and supported by core 76. Door 60 is provided with a flexible nose piece 78 which is set into a pair of grooves formed between core 76 and facings 72 and 74 by, for instance, removing a pair of notches (not shown) from the core corresponding to notches 39 of stile 36 of door 10. Core 76 is U-shaped, rather than being a solid rectangle, a rectangular notch 80 being cut through the core and extending from the top of the door downward to below the level of window aperture 62. Notch 80 is dimensioned to be wider than window aperture 62, and is positioned to extend slightly beyond either side of the aperture. Window pane 82, otherwise similar to pane 42, is dimensioned to fit within the compartment formed by notch 80 and panels 72 and 74, having a similar height and width as the notch and a similar thickness as core 76.

The embodiment of FIG. 4 may be used similarly to that of FIGS. 2 and 3, the extraction and reversal of pane 82 requiring it to be slid vertically within the door rather than horizontally, as is the case for pane 42. As the extraction of pane 82 is vertical, the pane is held in place by gravity, and no additional fixture, such as plug 44 of the embodiment of FIG. 2, is required to secure the pane in place against vibration. Further, as the top edge of door 60 is not easily accessible to view, the plug is not required to conceal the method of removal of the pane.

It will be understood that the embodiment of FIGS. 2 and 3, wherein the portion of the pane concealed within the door is to one side of the window, is particularly suitable for use with windows which are to be mounted eccentrically toward one of the vertical edges of the door. Similarly, the embodiment of FIG. 4 is particularly suitable for use with centrally disposed windows, or with windows which extend across a significant fraction of the width of the door. It should be noted, however, that either embodiment could be modified to accommodate various locations of the aperture defining the window opening. All that is required to permit replacement of the window by a reversal of the pane is that the window opening be eccentrically mounted with regard to the compartment containing the pane, so as to come opposite no more than half of the pane while leaving a symmetrically disposed similar portion of the pane (e.g., for the preferred embodiment of at least a contiguous half of the pane) concealed within the door. Thus, for instance, the window opening might be situated wholly within the top (or bottom) half of a horizontally-opening compartment, and the pane reversed top for bottom after being withdrawn horizontally. Then again, the compartment and the pane might both be square, rather than rectangular, and the window opening disposed within one of the quadrants of the square. This last structure allows a single pane to be used four times, rather than twice, the pane being rotated 90 degrees to replace a damaged window. It should also be noted that the window opening might comprise a number of spaced-apart apertures eccentrically disposed with respect to the compartment, the inter-aperture spacing concealing the portion of the pane held in reserve.

Yet other changes may be made in the embodiments herein described without departing from the scope of the present invention. Thus, for instance, the embodiment of FIGS. 2 and 3 may be incorporated into a solid-core door, the core being provided with an appropriate horizontal cavity. Then too, the embodiment of FIG. 4 may be adapted for use with a hollow-core door, the frame holding pane 82 being supplied by an auxiliary rail and one or more mullions. It will also be understood that the aperture defining the window may be variously shaped, that the door need not be a swinging door, and that the door might be hinged to swing about other than a vertical axis.

Since these and other changes may be made in the above apparatus without departing from the scope of the invention herein involved, it is intended that all matter contained in the above description or shown in the accompanying drawing shall be interpreted in an illustrative and not in a limiting sense.

What is claimed is:

1. A door comprising in combination:

a pair of similar spaced apart in parallel confronting relationship to one another so as to form an interior compartment therebetween, said compartment communicating with the exterior of said door through an edge of the door;

a pane of transparent material shaped and dimensioned to slidably fit into said compartment so that the pane may be reversed in the compartment; and a window opening having an area less than half that of said pane in each of said panels, said openings being in line with one another and and a portion of said pane so as to permit vision therethrough and further being aligned eccentrically with regard to said compartment so as to conceal a symmetrically disposed similar portion of said pane.

2. A door comprising in combination:

a plurality of substantially rectangular panels;

means for holding said panels in parallel spaced-apart confronting relationship to one another;

mutually confronting means in each panel defining a window opening having predetermined linear dimensions;

means defining a rectangular compartment between said panels, said compartment being in open communication with a selected edge of said door and having at least one linear dimension parallel an edge of said door at least twice as large as a corresponding dimension of said window opening, said window opening and said rectangular compartment being dispoed relative to one another so that said window opening is opposite and opens into said compartment with at least a symmetrically disposed similar portion of said compartment not opposite said window opening; and a rectangular pane of transparent material shaped and dimensioned to slidably fit into said compartment.

3. The door according to claim 2 wherein said symmetrically disposed similar portion of said compartment comprises at least a contiguous half of said corresponding dimension of said compartment.

4. The door according to claim 2 wherein said means for holding is a U-shaped solid core.

5. The door according to claim 2 wherein said means for holding is a rectangular frame peripherally disposed about said panels so as to define an open interior space between said panels, said assembly further incorporating framing members within said interior space, said members in part defining said compartment, and said frame further having at least a portion of an edge member removed so as to provide edge access to said compartment.

6. The door according to claim 4 or 5 wherein said selected edge is a vertical edge.

7. The door according to claim 2 further including a plug for closing said compartment at said selected edge.

8. The door according to claim 7 wherein said selected edge is the hinged edge of said door.

9. The door according to claim 4 or 5 wherein said selected edge is a horizontal edge.

10. The door according to claim 9 wherein said horizontal edge is the top edge.

* * * * *

UNITED STATES PATENT AND TRADEMARK OFFICE

CERTIFICATE OF CORRECTION

PATENT NO. : 4397117
DATED : August 9, 1983
INVENTOR(S) : Earl H. Shipp

It is certified that error appears in the above-identified patent and that said Letters Patent is hereby corrected as shown below:

Claim 1, column 5, line 28, "panels" should be inserted after -- similar --.

Claim 1, column 5, line 38, "and" (second occurrance) should be deleted.

Claim 2, column 6, line 13, "dispoed" should be -- disposed --.

Signed and Sealed this

First Day of November 1983

[SEAL]

Attest:

GERALD J. MOSSINGHOFF

Attesting Officer

Commissioner of Patents and Trademarks